United States Patent [19]

Dewallens

[11] 4,187,154

[45] Feb. 5, 1980

[54] METHOD FOR MANUFACTURING SUBSTANTIALLY FLAT DIES

[75] Inventor: Léon Dewallens, Louvain, Belgium

[73] Assignee: Fabrication Belge de Disques "Fabeldis", Molenbeek-Saint-Jean, Belgium

[21] Appl. No.: 930,660

[22] Filed: Aug. 2, 1978

Related U.S. Application Data

[62] Division of Ser. No. 831,351, Sep. 7, 1977, Pat. No. 4,120,771.

[30] Foreign Application Priority Data

Sep. 10, 1976 [BE] Belgium ..... 170518

[51] Int. Cl.[2] ..... C25D 1/00; C25D 1/10

[52] U.S. Cl. ..... 204/5; 204/6

[58] Field of Search ..... 204/5, 6, 4, 23

[56] References Cited

U.S. PATENT DOCUMENTS

| | | | |
|---|---|---|---|
| 966,097 | 8/1910 | Hooricky | 204/225 |
| 1,603,951 | 10/1926 | Hitchcock | 204/226 |
| 2,067,502 | 1/1937 | Pollard et al. | 204/5 |
| 2,075,646 | 3/1937 | Hewitt | 204/5 |
| 2,181,490 | 11/1939 | Lowe | 204/218 |
| 3,186,932 | 6/1965 | Gelfand et al. | 204/5 |
| 3,963,587 | 6/1976 | Kreckel | 204/4 |

*Primary Examiner*—T. M. Tufariello

*Attorney, Agent, or Firm*—Browdy and Neimark

[57] ABSTRACT

There is described a method for manufacturing by electroplating substantially flat dies or similar, which comprises adjusting the electric current strength by varying the sparing between the cathode and the anode inside the electrolyte proper.

6 Claims, 2 Drawing Figures

METHOD FOR MANUFACTURING SUBSTANTIALLY FLAT DIES

This is a division of application Ser. No. 831,351 filed Sept. 7, 1977, now U.S. Pat. No. 4,120,771.

This invention relates to a method for manufacturing substantially flat dies or similar, particularly a die or counterpart for gramophone records, which are essentially comprised of a part made from a low electric conductivity material which has been previously metallized, which comprises introducing said part into a metal salt-based electrolyte in such a way that said part forms the cathode, the feeding of a relatively low electric current through said electrolyte between said cathode and an anode mounted inside said electrolyte some distance away from the cathode, and the adjusting of the current to form by electroplating a deposit with a suitable thickness from said metal which is contained in said electrolyte, on said part.

In the most currently used method for manufacturing by electroplating, flat or slightly curved moulds, that cathode on which said moulds are formed is subjected to a rotating motion relative to the anode. This method is particularly applied to the preparation of dies and counterparts for the manufacture of gramophone records and similar.

This method has however some drawbacks. Indeed due to the cathode generally being comprised in the above application, of a part from non-conductive material covered with a thin metal film of a few millimicrons thickness, it is necessary to limit strongly the electric current strength in the electroplating bath electrolyte at the start of the electrolysis to obtain on said cathode-forming part a fine and homogeneous cristallyzing and a high penetration factor for the metal deposit. Consequently a bad surface crystallizing in the dies for gramophone record manufacturing can be the cause of the scratching noise heard when listening to a record made from such a die.

Moreover after the deposit of some metal on the cathode and consequently an increase in the conductivity thereof, it is necessary to increase the current strength to insure an industrially workable efficiency of the metal deposit on the cathode, so as to obtain a die with the required thickness in a minimum time.

Up to now use has generally been made of hand adjustments to vary the current strength in the electroplating bath electrolyte according to the increasing thickness of a metal deposit formed at the cathode.

To reach good results said adjustment should be extremely accurate, which requires skilled operators to monitor continuously very closely the development of the electrolysis.

Even with all of the possible precautions on an industrial scale that is in the shop, where large current variations are constantly encountered it is substantially impractical to avoid interferences in the electrolysis current which have a direct influence on the quality of the metal deposit at the cathode.

An essential object of this invention is to obviate said drawback and to provide a method for automatizing the adjustment of the current strength according to the electrolysis development, that is the formation of the metal deposit on the cathode-forming part.

According to the invention, said electric current strength is adjusted by varying the spacing between the cathode and the cathode inside the electrolyte proper.

Advantageously after introducing the part forming the cathode into the electrolyte, the spacing between said part and the anode is lowered in such a way as to increase continuously the electric current strength therebetween.

In an advantageous embodiment, the cathode and the anode are subjected to at least two succeeding closing operations inside the electrolyte by providing in-between a spreading operation for the cathode and anode, the strength of that electric current fed to the cathode and anode terminals being increased before starting a new closing operation.

The invention also relates to a device for manufacturing by electroplating, substantially flat dies or similar which comprises a container for containing an electrolyte, at least one anode mounted therein, and a cathode current supply provided with a support for a part which is to form the cathode, means being provided to introduce said part into the electrolyte and to remove same from said electrolyte.

Said device is characterized by comprising means for bringing in a substantially continuous way the cathode-forming part closer to the anode when said part is introduced into the electrolyte.

Other details and features of the invention will stand out from the following description given by way of non limitative example and with reference to the accompanying drawings, in which.

In both figures the same reference numerals pertain to similar elements.

Figure 1:
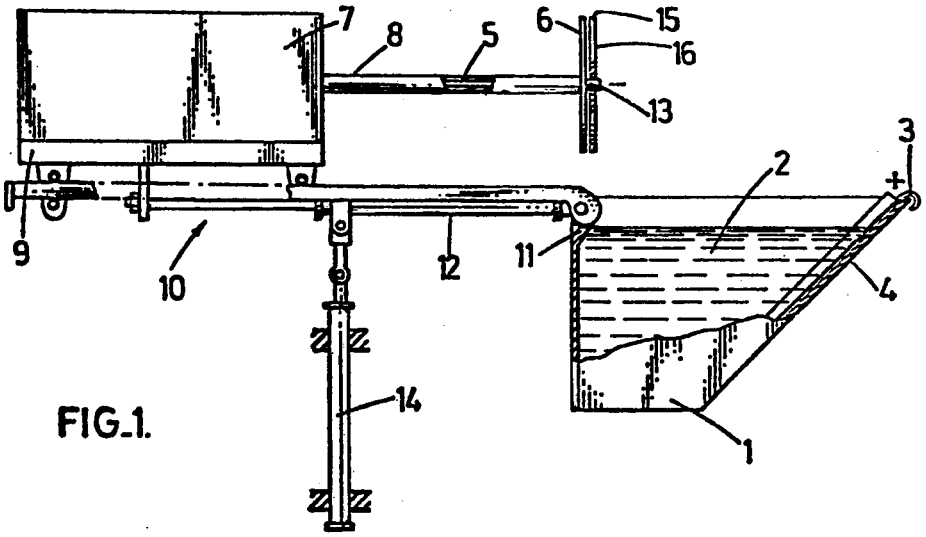
FIG. 1 is a diagrammatic elevation view of a particular embodiment of a device for manufacturing gramophone record dies in the rest position thereof.

Even if the invention object is not absolutely bound to the preparation of dies or counterparts for records, it is to be noted that the method according to the invention is of particular interest for such an application.

For this reason to illustrate as concretely as possible the invention, examples of preparation of such dies will be given hereinafter.

A circular part which is generally made from a nitrocellulose compound poured on a support is provided with a sound engraving. Said part is thus made from a material that does not conduct electricity. Said part is then treated to make same conductive and in this respect, a thin metal layer, for example a silver or nickel layer with a thickness of a few millimicrons is deposited on said engraving, for instance by vaporinzing or some other suitable known process.

This part thus previously metallized is introduced into a metal-based electrolyte, for example nickel-based, and it is connected to a cathode current supply to thus form in turn a cathode for forming thereon a die, by electroplating.

Into said electrolyte is further mounted an anode which is connected to an anode current supply.

Due to the small thickness of the metal layer formed on the cathode-forming circular part at the start, the current strength in the electrolyte between the cathode and anode, should be relatively low and this until some metal has been deposited by electrolysis on the cathode surface To the contrary, once some metal has been deposited on said cathode, to obtain a working efficiency, that is the formation of a thick metal layer in a minimum of time, use should be made of a high-strength electric current and the spacing between cathode and anode should be as small as possible. Thus it is necessary to go during the electrolysis from a low-strength current to a high-strength current.

This increase in the current strength should occur stepwise and with much care according to the increasing thickness of the metal deposit at the cathode.

According to the invention, the current strength is adjusted by varying the spacing between cathode and anode inside the electrolyte.

Thus advantageously, to increase continuously the current strength between cathode and anode, the spacing between said part and the anode is continuously reduced, preferably without acting on the electric voltage across the anode and cathode during said closing operation.

Thus practically, the cathode-forming part connected to the cathode supply is arranged at a great distance from the anode and across the anode and cathode is fed an electric voltage which corresponds to a lowest current strength.

Thereafter, the cathode-forming part is slowly brought closer to the anode, for example by means of a hydraulic mechanism. This results in a regular and automatic increase in the current strength between cathode and anode.

Practically the spacing between cathode and anode may vary beween 250 and 50 mm. Of course these are not imperative limits and other variations in the spacing can be contemplated.

With the method according to the invention, it is possible to form at the start of the electrolysis on the cathode-forming surface, a very thin and dense deposit of the metal concerned, for example nickel, with a high hardness, the penetration factor of which is thus very large and then by increasing progressively and automatically the current strength, after some metal has been settled on the part, to generate the ideal conditions for the formation of fast deposits in thick layers, in a minimum time. This is thus due to the fact that at the start the current strength is very low and then by a constant and smooth decrease of the spacing between anode and cathode, the minimum spacing therebetween is reached in such a way that a high current strength under low voltage is generated.

In a particular embodiment, it is possible to obtain a very large variation in the current strength within a very small electrolyte volume. The closing of the cathode-forming part is made automatically over a distance from 250 to 50 mm relative to the anode for a well-determined starting voltage. At the moment where the cathode-forming part reaches a distance of 50 mm from the anode, said part is raised from the electrolyte and brought back to its starting point, that is again at 250 mm from the anode. At the same time for instance, due to an electric contact operating on current rectifiers, the current strength between cathode and anode is very substantially increased. At this time, the cathode-forming part is again brought closer to the anode, down to 50 mm therefrom.

Said spacing operation may possibly be repeated and followed by a new closing operation for an even larger initial current strength, according to the desired thicknes of the deposit at the cathode-forming part.

In this way the current ratios can easily reach a proportion of 1 to 50 and the flat dies and counterparts can be manufactured under ideal deposit conditions and this with a current consumption accurately adapted to each intermediate deposit thickness.

As there results from the above, the invention lies actually in regulating the variation of the current strength between the cathode-forming part and the anode, in a round-about way, with purely mechanical means. It has been noticed unexpectedly that this allows to eliminate the interferences inside the electrolyte, which result in a heterogeneous distribution of the deposit formed on the cathode-forming part and consequently the obtaining of low-quality dies.

Such strays of interferences occur for instance if use is made of a direct-regulating system for the electric current by means of rheostats or similar, even if a maximum of care is taken, such continuous maintenance of the various electric contacts to prevent any oxiding.

The accompanying figures show diagrammatically a particular embodiment of a device for the working of the above method which has shown very good results.

Said device comprises a container 1, for example from polypropylene for the electrolyte 2 that contains a salt based on some metal to be deposited on the cathode-forming part, one or a plurality of anodes 3 extending along a slanting wall 4 of container 1, a cathode current supply 5, a support 6 for said part, a reducing gear-motor set 7 and a shaft 8 connecting said set to support 6.

The unit formed by the gear-motor set 7, the shaft 8 and the support 6, is mounted on a carriage 9 that moves on a swinging frame 10 which is hinged on the edge 11 of that container wall opposite the slanting wall 4. A jack 14 allows to raise the frame 10 and rotate same about edge 11 of container 1. The carriage 9 is driven in turn by a hydraulic or pneumatic jack 12 which allows to move same with a substantially continuous and very slow movement towards anode 3 and with a motion in the opposite direction, that is with an alternating movement along a direction at right angle to the rotating axis of frame 10.

The support 6 for the cathode-forming part is comprised of a circular tray which is made of example from polypropylene and integral with shaft 8. Through said tray goes an electric contact screw 13 for the cathode supply 5 which fastens said tray on the free end of shaft 8.

Cathode current supply 5 is comprised of an insulated rod from copper-beryllium alloy which extends inside shaft 8, which is rotated about its axis by the gear-motor set 7.

The working of this device will be described hereinafter.

Before starting the device, when said device lies in the rest condition thereof, the frame 10 lies in a substantially horizontal position and carriage 9 lies in the position thereof farthest away from container 1 (FIG. 1). A cathode-forming part 15, made from a non-conducting material such as a nitrocellulose compound, which bears on the one side 16 thereof a sound engraving over which is laid a thin metal film, is mounted against tray 6.

Thereafter, the frame 10 is raised until tray 6 be substantially parallel with anode 3 and an electric voltage is applied across said anode and cathode supply 5.

The gear-motor set 7 is started to rotate tray 6 and consequently part 16 about the axis of shaft 8. The resulting position has been shown in solide lines in FIG. 2.

Figure 2:
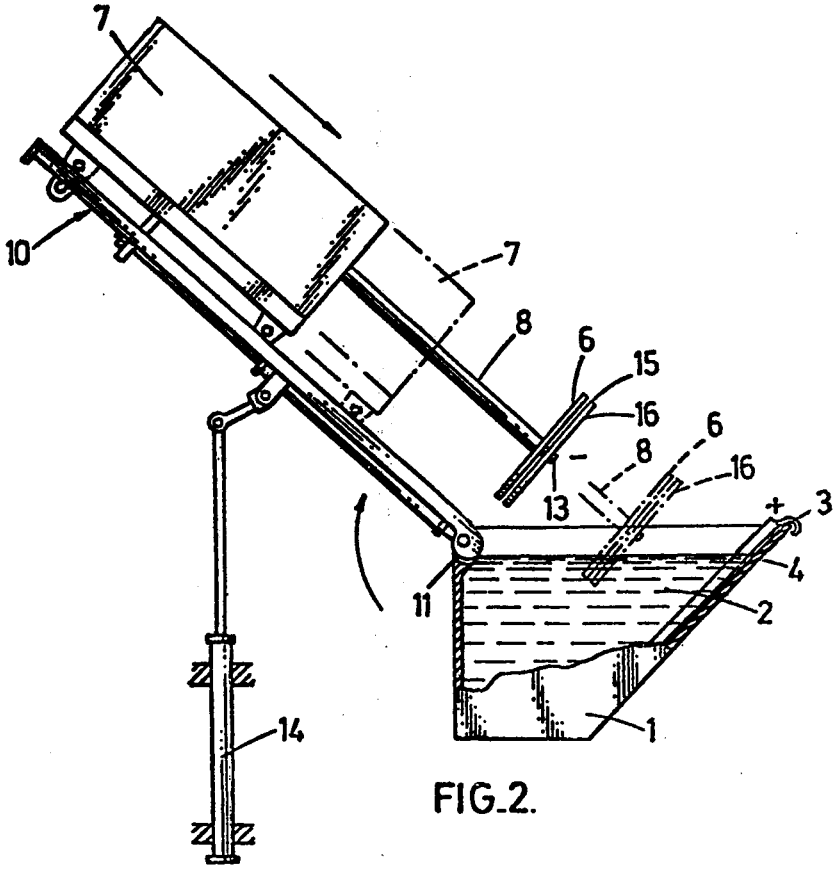
FIG. 2 is a diagrammatic view of the same embodiment in the working position thereof.

Then by means of jack 12, carriage 9 is subjected to a very slow translating towards the anode and tray 6 which bears part 16, then first dips partly into the electrolyte 2 as shown in dotted lines in FIG. 2.

Due to the relatively wide original spacing between cathode and anode, the current strength is low at the start.

The tray dips more and more into the electrolyte as it gets nearer the anode 3, until said tray is completely immersed when it lies in the position thereof closest to the anode. At this moment the current strength reaches a maximum. The mean displacement speed of the cathode-forming part is generally of about 3 cm/minute.

As already mentioned above, the continuous closing motion into the electrolyte of the cathode-forming part towards the anode, insures a continuous increase in the strength of the ion flow and this in such a way that interferences which might occur at the level of the cathode supply terminals and the anode terminals do not influence that deposit formed on the cathode-forming part.

It has been noticed in this respect that by means of said device, it is no more necessary to take into account the interference which might possibly occur in the outer current supply to the electrodes and it is no more necessary to adjust the electric voltage at the electrode terminals during all of the electrolysis. If use is made of devices where the spacing between anode and cathode is fixed, it is required to adjust the variation of the low current strength at the beginning of the electrolysis and of the high current strength at the end thereof.

Still another substantial advantage relative to the known devices for manufacturing dies for gramophone records is the possibility of getting the cathode-forming part much nearer the anode in the device according to the invention, down to about 4 to 5 cm.

Indeed in the conventional devices where the spacing between cathode and anode is fixed, it is necessary to maintain a sufficient spacing between the anode and said part to let said part rotate out of the electrolyte at the end of the electrolysis.

In the device according to the invention, the carriage 9 is possibly backed up to the rest position thereof to make the removing of the cathode-forming part easier, said part bearing the cathode deposit which comprises the resulting die.

If it is desired to repeat the operation, it is but necessary to bring the carriage 9 back to the position thereof farthest away on frame 10 and to start again the translating movement towards the anode, after bringing the electric voltage to a higher value, for example with an electric contact which occurs during the backing-up of the carriage and which connects current rectifiers for a higher current strength.

All of the above-described operations can be made in synchronism and completely automated.

It must be understood that the invention is not limited to the above embodiments and that many changes can be made therein without departing from the scope of the invention as defined by the appended claims.

For instance in some applications, the cathode can be fixed and the anode can be moved gradually closer to the cathode or else both the cathode and anode can be movable.

The raising of frame 10 and the moving forward of carriage 9 thereof could be made with other known means such as mechanical jacks, electric motor, etc.

I claim:

1. Method for manufacturing substantially flat dies or similar, particularly a die or counterpart for gramophone records, which are essentially comprised of a part made from a low electric conductivity material which has been previously metallized, including introducing said part into a metal salt-based electrolyte in such a way that said part forms the cathode, the feeding of a relatively low electric current through said electrolyte between said cathode and an anode mounted inside said electrolyte some distance away from the cathode, the adjusting of the current to form by electroplating a deposit with a suitable thickness from said metal which is contained in said electrolyte, on said part, in which said electric current strength is adjusted by varying the spacing between the cathode and the anode inside the electrolyte proper, in which the spacing between the cathode-forming part and the anode is decreased continuously without influencing the electric voltage at the anode and cathode terminals during said closing operation, and maintaining the faces of the substrate and the anode substantially parallel to each other.

2. Method as defined in claim 1, in which after introducing the part forming the cathode into the electrolyte, the spacing between said part and the anode is lowered in such a way as to increase continuously the electric current strength therebetween.

3. Method as defined in claim 1, in which the cathode and the anode are subjected to at least two succeeding closing operations inside the electrolyte by providing in between a spreading operation for the cathode and anode, the strength of that electric current fed to the cathode and anode terminals being increased before starting a new closing operation.

4. Method as defined in claim 3, in which during the spreading operation, the electric current between anode and cathode is cut-off.

5. Method as defined in claim 1, which further comprises moving but the cathode-forming part to adjust the current strength between said cathode and anode.

6. Method as defined in claim 1, which further comprises varying the strength of the electric current between cathode and anode within a ratio of about 1 to 50 .

* * * * *